US006203448B1

(12) United States Patent
Yamamoto

(10) Patent No.: US 6,203,448 B1
(45) Date of Patent: Mar. 20, 2001

(54) METALLIC HOLLOW GOLF CLUB HEAD

(75) Inventor: Shinji Yamamoto, Hiratsuka (JP)

(73) Assignee: The Yokohama Rubber Co., Ltd., Tokyo (JP)

( * ) Notice: Subject to any disclaimer, the term of this patent is extended or adjusted under 35 U.S.C. 154(b) by 0 days.

(21) Appl. No.: 09/481,323

(22) Filed: Jan. 11, 2000

Related U.S. Application Data

(62) Division of application No. 09/283,148, filed on Apr. 1, 1999, now Pat. No. 6,033,321, which is a division of application No. 08/931,269, filed on Sep. 16, 1997, now Pat. No. 5,935,019.

(30) Foreign Application Priority Data

Sep. 20, 1996 (JP) ..... 8-250485

(51) Int. Cl.[7] ..... A63B 53/04
(52) U.S. Cl. ..... 473/338; 473/345; 473/349
(58) Field of Search ..... 473/324, 334, 473/335, 336, 337, 338, 339, 343, 344, 345, 346, 349, 341, 256, 291

(56) References Cited

U.S. PATENT DOCUMENTS

| | | | |
|---|---|---|---|
| 4,052,075 | | 10/1977 | Daly . |
| 4,795,159 | | 1/1989 | Nagamoto . |
| 4,803,023 | | 2/1989 | Enomoto et al. . |
| 4,824,116 | | 4/1989 | Nagamoto et al. . |
| 5,501,459 | | 3/1996 | Endo . |
| 5,533,725 | | 7/1996 | Reynolds, Jr. . |
| 5,669,825 | | 9/1997 | Shira . |
| 5,720,674 | | 2/1998 | Galy . |
| 5,776,011 | | 7/1998 | Su et al. . |
| 5,935,019 | * | 8/1999 | Yamamoto . |
| 6,033,321 | * | 3/2000 | Yamamoto . |

* cited by examiner

*Primary Examiner*—Sebastiano Passaniti
(74) *Attorney, Agent, or Firm*—Finnegan, Henderson, Farabow, Garrett & Dunner, L.L.P.

(57) ABSTRACT

A metallic hollow golf club head comprising a sole plate molded from a light metal and formed with a fitting hole, and a weight of a heavy metal press-fitted into the fitting hole and fixed solidly to the sole plate. Also disclosed is a metallic hollow golf club head comprising a sole plate molded from a light metal and formed with a fitting hole, and a weighted structure comprising a weight of a heavy metal press-fitted into a ring-shaped spacer of the same light metal as the sole plate, the weighted structure being fitted into the fitting hole, and the ring-shaped spacer and the sole plate being welded together. Also disclosed is metallic hollow golf club head comprising a sole plate molded from a light metal and formed with a fitting hole, and a weighted structure comprising a weight of a heavy metal wrapped with a belt-shaped spacer of the same light metal as the sole plate, the weighted structure being fitted into the fitting hole, and the belt-shaped spacer and the sole plate being welded together.

5 Claims, 7 Drawing Sheets

METALLIC HOLLOW GOLF CLUB HEAD

This is a division of application Ser. No. 09/283,148 filed Apr. 1, 1999 now U.S. Pat. No. 6,033,321 which is a division of application Ser. No. 08/931,269 filed Sep. 16, 1997 (U.S. Pat. No. 5,935,019).

BACKGROUND OF THE INVENTION

The present invention relates to a structure for securing a weight to a metallic hollow golf club head and more particularly to a metallic hollow golf club head in which a weight formed from a different type of metal to a sole plate on the main body of the club head formed from titanium or titanium alloy can be firmly secured thereto.

In recent years, a hollow golf club head consisting of the light metal titanium or titanium alloy has attracted considerable attention due to its superior driving distance capacity. Since this hollow golf club head is made from light metal, a weight consisting of metal having a large specific gravity is secured to the inner surface of the sole plate in order to lower the center of gravity and increase the moment of inertia.

Generally, however, it is difficult to weld together metals of different types, and especially difficult when one of the metals is titanium or a titanium alloy. Consequently, when the sole plate and the weight consist of metals of different types such as in the above-mentioned hollow golf club head, there has been a problem of insufficient strength in the welded joint.

A conventional countermeasure against this problem was disclosed in Japanese patent application Kokai publication No. 6-296716 which proposed a method of securing a weight to the sole plate using a screw. However, this type of securing method has the disadvantage that when the head is used as a golf club head, vibration resulting from striking the ball or making contact with the ground produces unpleasant sounds and causes looseness.

Alternatively, as shown in FIG. 15, a securing method has been proposed wherein the weight 4 is fitted to the sole plate 2 by means of a dovetail groove. However, this method has the disadvantage that the high-precision manufacturing processing required is time-consuming and increases costs.

SUMMARY OF THE INVENTION

It is therefore the object of the present invention to provide a metallic hollow golf club head in which a weight formed from metal can be firmly secured to a sole plate formed from a different type of light metal.

In order to achieve the above objective, a metallic hollow golf club head of the present invention comprises a sole plate molded from a light metal and formed with a fitting hole, and a weight of a heavy metal press-fitted into the fitting hole and fixed solidly to the sole plate.

Furthermore, a metallic hollow golf club head of the present invention comprises a sole plate molded from a light metal and formed with a fitting hole, and a weighted structure comprising a weight of a heavy metal press-fitted into a ring-shaped spacer formed of the same light metal as the sole plate, said weighted structure being fitted into the fitting hole, and the ring-shaped spacer and the sole plate being welded together.

Furthermore, a metallic hollow golf club head of the present invention comprises a sole plate molded from a light metal and formed with a fitting hole, and a weighted structure comprising a weight of a heavy metal wrapped with a belt-shaped spacer formed of the same light metal as the sole plate, said weighted structure being fitted into the fitting hole, and the belt-shaped spacer and the sole plate being welded together.

Thus, the weight is press-fitted into the fitting hole provided on the sole plate of a light metal such as titanium and titanium alloy. When necessary, a through hole passing through the weight and the sole plate is provided for inserting and caulking a rivet. Alternatively, the weight structure comprising the weight press-fitted into the ring-shaped spacer or wrapped with the belt shaped spacer of the same light metal as the sole plate is fitted into the fitting hole of the sole plate, and the spacer and the sole plate are welded together. Consequently, the weight can be firmly secured to the sole plate and a low center of gravity and increased moment of inertia can be obtained in the main body of a light metallic head.

For a more complete understanding of the present invention and the advantages thereof, reference is now made to the following description taken in conjunction with the accompanying drawings.

BRIEF DESCRIPTION OF THE DRAWINGS

FIG. 7(*b*) is a diagonal view of a belt-shaped spacer for similar use;

DETAILED DESCRIPTION OF THE PREFERRED EMBODIMENTS

Figure 1:
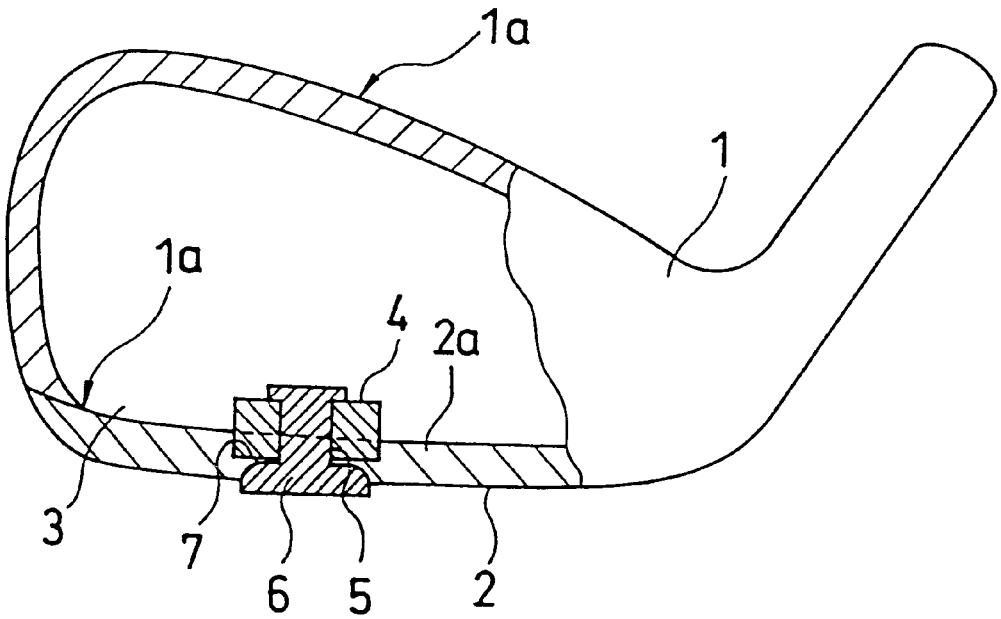
FIG. 1 is a partial cross-sectional diagram depicting an iron type golf club head according to a first embodiment of the present invention.

FIG. 1 depicts an iron type golf club head according to a first embodiment of the present invention, in which a hollow club head 1 has a structure wherein a sole plate 2 is welded to the open portion 3 of an outer mold 1*a*. The outer mold 1*a* and the sole plate 2 are formed from a light metal of titanium or titanium alloy respectively.

A fitting hole 7 is provided on the inner surface 2*a* of the sole plate 2 and a weight 4 is press-fitted into this fitting hole 7. The lower part of the weight 4 has the same shape as the fitting hole 7 and is manufactured to the same dimensions as the fitting hole 7. The fitting hole 7 is for instance circular when viewed from above with a depth of 0.5 mm or more and smoothly countersunk at the bottom. The weight 4 comprises a heavy metal having a specific gravity of 10 or more; for instance, tungsten, tantalum, brass, copper, copper alloy, gold, platinum or the like can be used.

Figure 3:
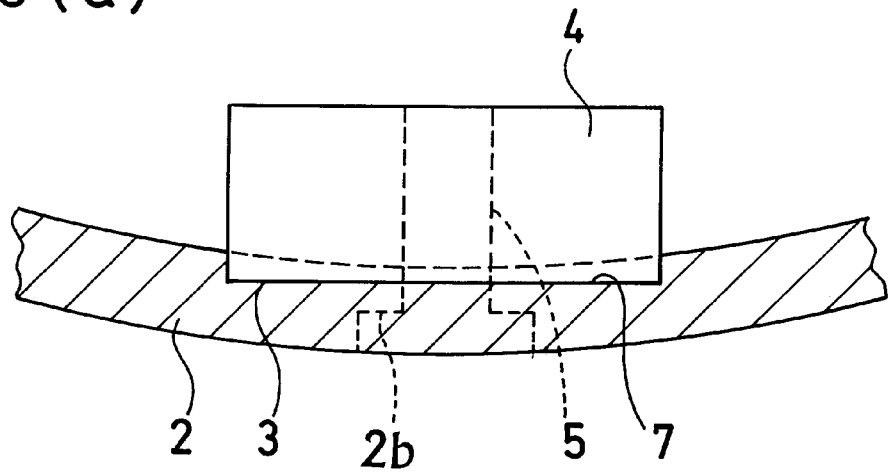
FIGS. 3(*a*) to 3(*c*) are diagrams explaining the processes when attaching a weight to a sole plate in the first embodiment shown in FIG. 1.
Figure 3:
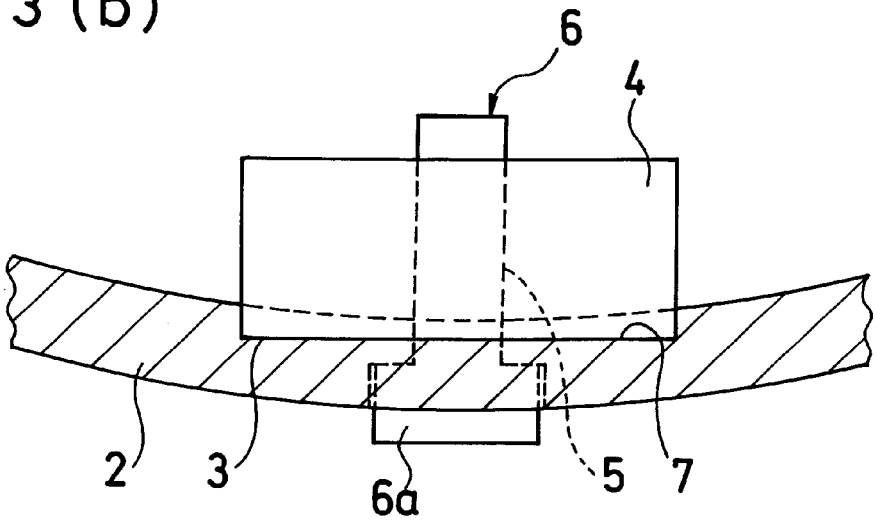
Figure 3:
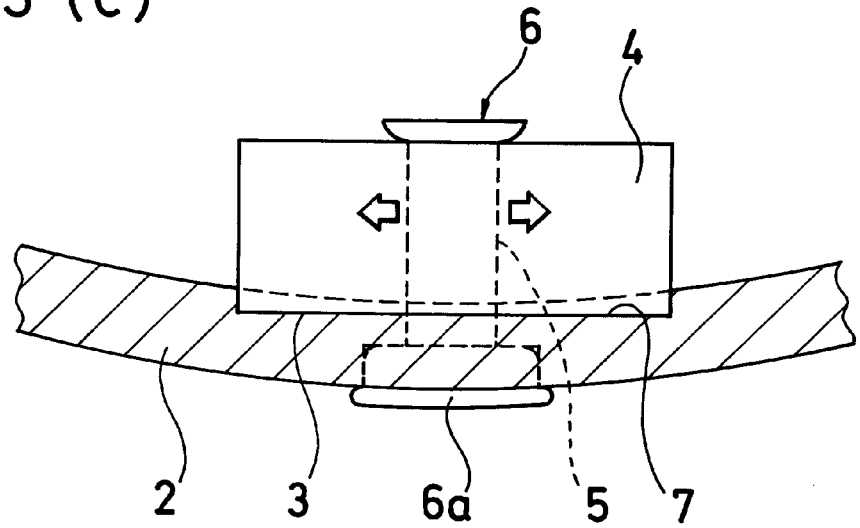

The weight 4 is secured to the sole plate 2 following the sequence of processes shown in FIG. 3(*a*) to FIG. 3(*c*). Firstly, a fitting hole 7 which is circular when viewed from above and has a bottom is constructed on the inner surface of the sole plate 2 and the lower portion of a cylindrical weight 4 is press-fitted into this fitting hole 7 as shown in FIG. 3(*a*). Next, a through hole 5 is created passing through both the sole plate 2 and the weight 4. Now a countersink 2*b* is created at the entrance side of the through hole 5. Next, a steel rivet 6 having ductility of for instance SUS304 is inserted through the through hole 5 as shown in FIG. 3(*b*). The rivet 6 is compressed in the direction of its axis causing the end portions of the rivet 6 to alter to the shapes depicted in FIG. 3(*c*) and also causing the rivet 6 to expand in the direction of its diameter, thereby producing friction between the rivet 6 and the weight 4 and between the rivet 6 and the sole plate 2 which secures the weight 4 to the sole plate 2 more firmly.

Figure 4:
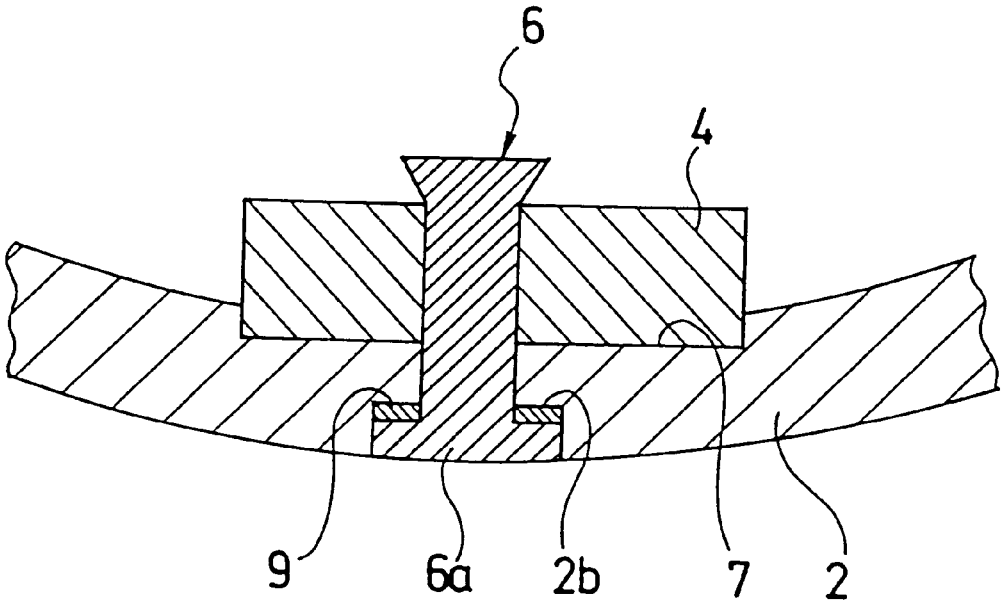
FIG. 4 is an diagram depicting an enlarged cross-sectional view of another example of a weight attached to a sole plate in the first embodiment shown in FIG. 1.

If necessary, minute differences in the dimensions of the various components or minute misalignments generated therein during press-processing can be accommodated by for instance providing a washer ring 9 between the rivet head 6*a* and the countersink 2*b* on the outer surface of the sole plate 2 as shown in FIG. 4, said washer ring 9 comprising a metal softer than the metals of the rivet head 6*a* and the countersink 2*b*.

Figure 2:
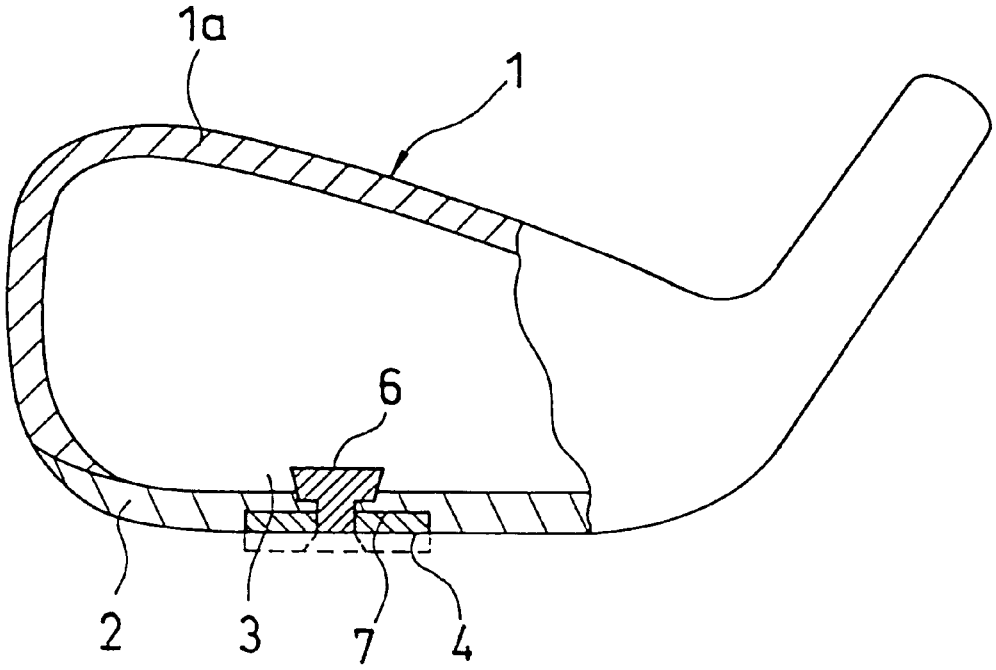
FIG. 2 is a partial cross-sectional diagram depicting an iron type golf club head according to a second embodiment of the present invention.

FIG. 2 depicts an iron golf club according to a second embodiment of the present invention. As the FIG. 2 shows, the weight 4 is secured into a fitting hole 7 created on the outer surface of the sole plate 2. Furthermore, the portion of the weight 4 (shown by a broken line) which protrudes from the outer surface of the sole plate 2 can be eliminated using polishing.

In each of the embodiments described so far, a weight 4 can be firmly secured to a sole plate 2 by press-fitting the weight 4 into a fitting hole 7 provided on a sole plate 2 comprising titanium or titanium alloy, inserting a rivet 6 into a through hole 5 which passes through both the sole plate 2 and the weight 4 and caulking the rivet 6 as required.

Since each of the embodiments uses press-fitting means, the dimensions of the weight 4 and the fitting hole 7 have to be precise. In order to simplify the mechanical manufacturing of these components the shape of the weight 4 and the fitting hole 7 when viewed from above may preferably be rectangular or more preferably circular.

Figure 5:
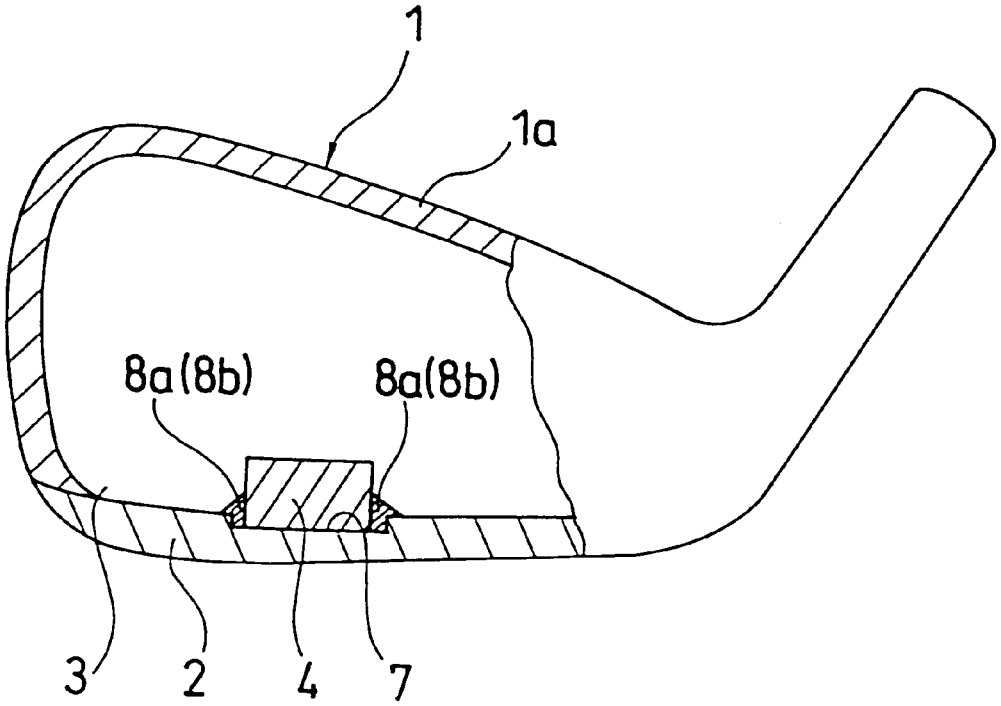
FIG. 5 is a partial cross-sectional diagram showing an iron type golf club head according to a third embodiment of the present invention.
Figure 6:
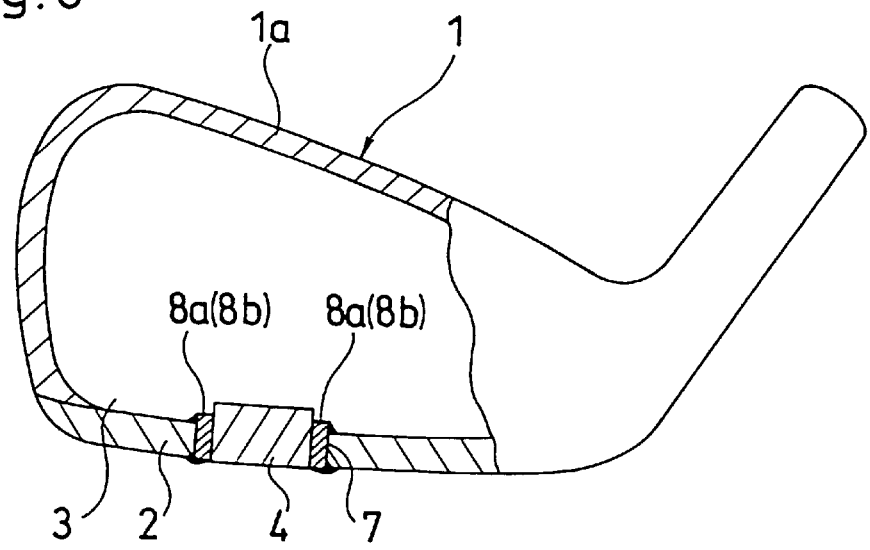
FIG. 6 is a partial cross-sectional diagram showing an iron type golf club head according to a fourth embodiment of the present invention.
Figure 7:
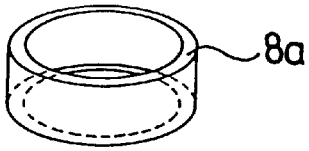
FIG. 7(*a*) is a diagonal view of a ring-shaped spacer forming a weighted structure used in the third and fourth embodiments of the present invention.
Figure 7:
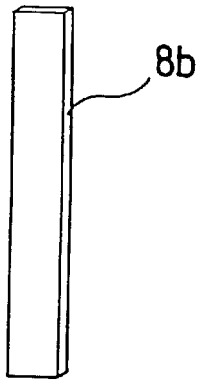
Figure 8:
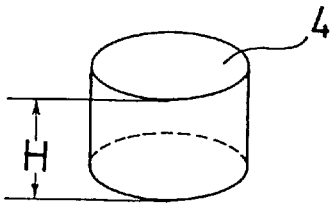
FIG. 8 is a diagonal view of a cylindrical weight forming a weighted structure in the third and fourth embodiments.
Figure 9:
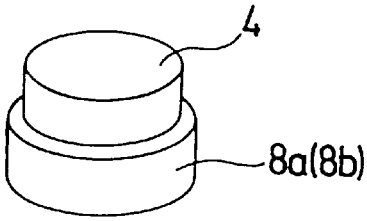
FIG. 9 is a diagonal view of a weighted structure in the third and fourth embodiments.

FIGS. 5 and 6 show an iron golf club in third and fourth embodiments of the present invention. These embodiments use a weighted structure in which a ring-shaped spacer 8*a* or a belt-shaped spacer 8*b* formed from the same light metal as the sole plate 2 is provided around the rim of the heavy metal weight 4. As shown in FIG. 7(*a*), the ring-shaped spacer 8*a* has an inner diameter roughly equal to the outer diameter of the weight 4 enabling it to be press-fitted around the rim of the weight 4. As shown in FIG. 7(*b*), the belt-shaped spacer 8*b* is molded into a rectangular shape. A weighted structure in which the spacer 8*a* or 8*b* is mechanically joined to the rim of the weight 4 as shown in FIG. 9 is formed by press-fitting the weight 4 inside the ring-shaped spacer 8*a* or wrapping the belt-shaped spacer 8*b* around the rim of the weight 4 to form a ring.

In FIG. 5, this weighted structure is fitted into a fitting hole 7 with a bottom provided on the light metal sole plate 2, and the sole plate 2 is welded to the spacer 8*a* or 8*b*. Alternatively, in FIG. 6 the weighted structure is fitted into a fitting hole 7 forming a through hole provided on the sole plate 2, and both inner and outer surfaces of the sole plate 2 are welded to the spacer 8*a* or 8*b*.

According to the embodiments described above, the weight 4 can be firmly secured to the sole plate 2 by solidly fitting a spacer 8*a* or 8*b* comprising the same light metal as the sole plate 2 to the rim of the weight 4 to form a weighted structure and welding the spacer 8*a* or 8*b* to the sole plate 2.

The wall thickness of the spacer 8*a* or 8*b* may preferably be not less than 1 mm in order to prevent distortion due to welding heat when the spacer 8*a* or 8*b* is secured; the height of the spacer 8*a* or 8*b* may preferably be not smaller than ½ of the height of the weight 4 to ensure that the weight 4 is firmly secured by the frictional force of the spacer 8*a* or 8*b* and inertial force generated by for instance striking a ball when the structure is used as a golf club does not cause the weight 4 to fall out.

Figure 10:
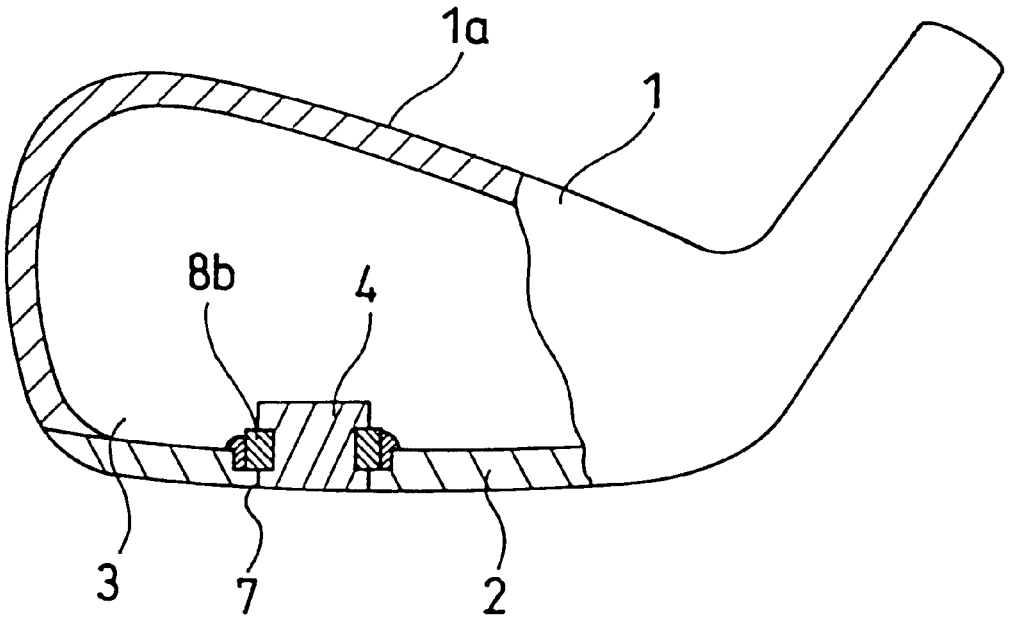
FIG. 10 is a partial cross-sectional diagram showing an iron type golf club head according to a fifth embodiment of the present invention.
Figure 11:
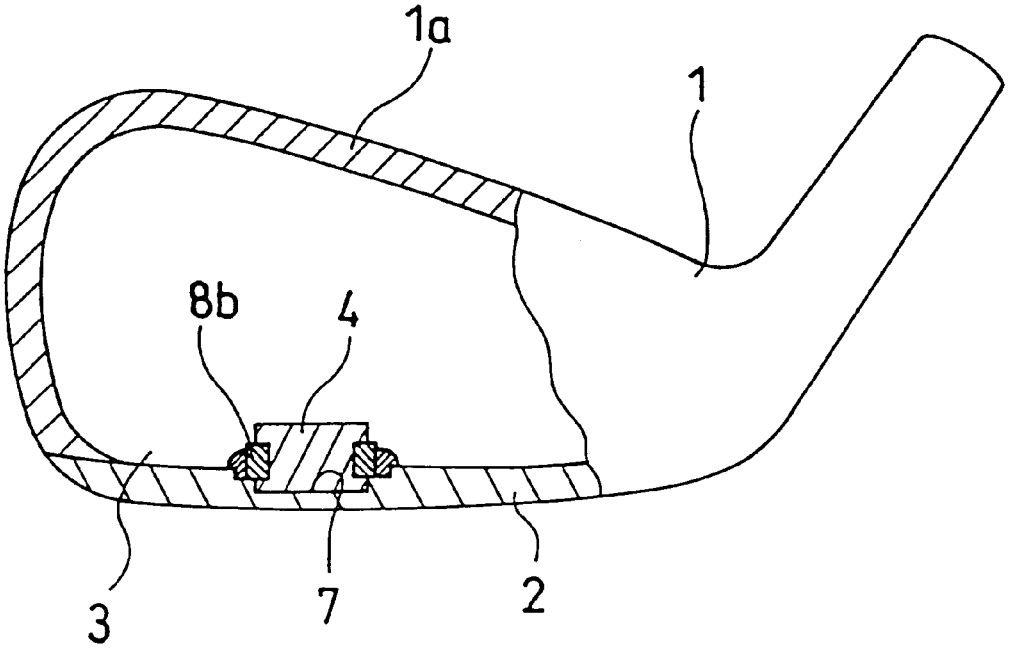
FIG. 11 is a partial cross-sectional diagram showing an iron type golf club head according to a sixth embodiment of the present invention.
Figure 12:
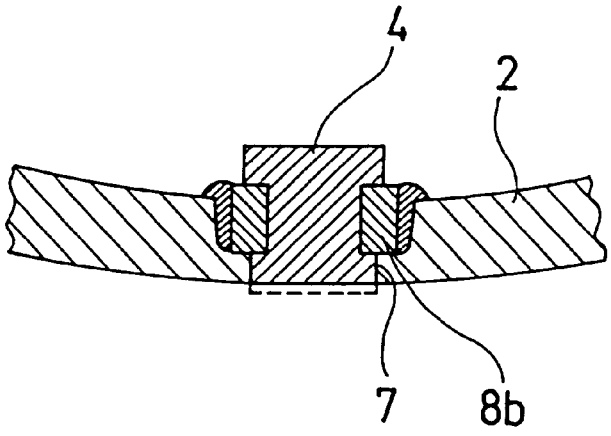
FIG. 12 is a partial enlarged view of the principal portion in FIG. 10.

FIGS. 10 to 12 depict varied configurations of the embodiments shown in FIGS. 5 and 6, in which the weight 4 is more firmly joined to the belt-shaped spacer 8*b* and the securing of the weight 4 to the sole plate 2 is strengthened by means of press-fitting.

Figure 13:
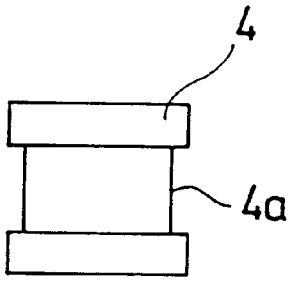
FIGS. 13(*a*) and 13(*b*) are front and top views of a weight in the fifth and sixth embodiments.
Figure 14:
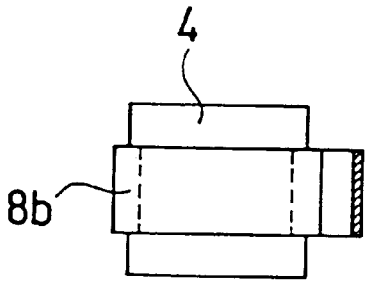
FIGS. 14(*a*) and 14(*b*) are front and top views of a weighted structure using the weight shown in FIGS. 13(*a*) and 13(*b*)
Figure 13B:
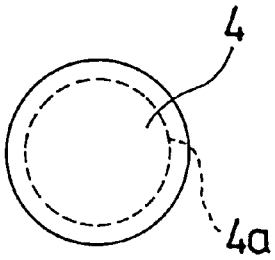
Figure 14:
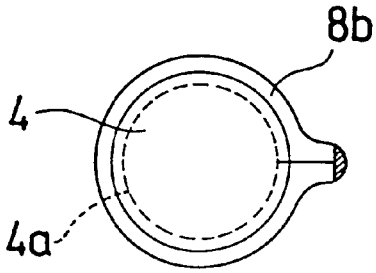
Figure 15:
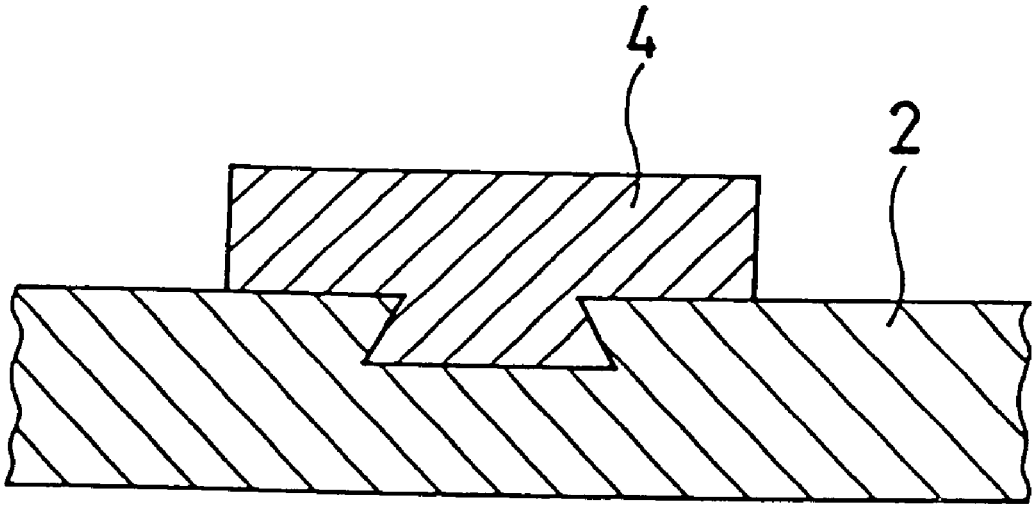
Fig.15 PRIOR ART
FIG. 15 is an enlarged cross-sectional view of a joined portion of a conventional weight.

The weight 4 is more firmly joined to the belt-shaped spacer 8*b* by the following method. As shown in FIGS. 13(*a*) and 13(*b*), a small diameter portion 4*a* having an outer diameter which is smaller than the diameters of the top and bottom ends of a cylindrical weight 4 is provided to the middle portion of the weight 4 in the height direction thereof. The weighted structures depicted in FIGS. 14(*a*) and 14(*b*) are formed by bending a belt-shaped spacer 8*b* of the kind shown in FIG. 7(*b*) into a ring and welding both ends together around the rim of this small diameter portion 4*a*. Thus the small diameter portion 4*a* of the weight 4 holds the spacer 8*b* securely in place, thereby preventing the spacer 8*b* and the weight 4 from becoming misaligned.

In FIGS. 10 and 12, the lower portion of the weight 4 is press-fitted into a fitting hole 7 which forms a through hole passing through the sole plate 2, said sole plate 2 being welded to the spacer 8*b*. Alternatively, in FIG. 11 the lower portion of the weight 4 is press-fitted into a fitting hole 7 with a bottom which is provided on the inside of the sole plate 2, said sole plate 2 being welded to the spacer 8*b*.

In each of these embodiments, the weight 4 can be firmly secured to the sole plate 2 by press-fitting said weight 4 into a fitting hole 7 provided in the sole plate 2, providing a spacer 8*b* comprising the same light metal as the sole plate 2 to the rim of the weight 4 and welding together the spacer 8*b* and the sole plate 2.

As explained above, according to the present invention, when adding a weight to the main body of the head in order to lower the center of gravity, increase the moment of inertia or adjust the position of the center of gravity, the weight can be firmly secured with a simple operation while preventing generation of unpleasant sounds due to collision with a ball or the ground when the head is used as a golf club head.

While there have been described what are at present considered to be preferred embodiments of the invention, it will be understood that various modifications may be made thereto, and it is intended that the appended claims cover all such modifications as fall within the true spirit and scope of the invention.

What is claimed is:

1. A metallic hollow golf club head comprising a sole plate molded from a light metal and formed with a fitting hole, and a weighted structure comprising a weight of a heavy metal press-fitted into a ring-shaped spacer of the same light metal as said sole plate, said weighted structure being fitted into said fitting hole, and said ring-shaped spacer and said sole plate being welded together.

2. A metallic hollow golf club head according to claim 1, wherein said fitting hole is a concave portion with a bottom provided on the inner surface of said sole plate.

3. A metallic hollow golf club head according to claim 1, wherein said fitting hole is a through hole provided on said sole plate.

4. A metallic hollow golf club head according to claim 1, wherein said light metal is a metal selected from groups of titanium and titanium alloy.

5. A metallic hollow golf club head according to claim 1, wherein said heavy metal is a metal having specific gravity of 10 or more selected from among tungsten, tantalum, brass, copper, copper alloy, gold and platinum.

* * * * *